US012311281B2

(12) United States Patent
Patel

(10) Patent No.: US 12,311,281 B2
(45) Date of Patent: May 27, 2025

(54) STACKABLE BLOCK

(71) Applicant: Rahul Patel, Los Angeles, CA (US)

(72) Inventor: Rahul Patel, Los Angeles, CA (US)

(73) Assignees: Rahul Patel, Los Angeles, CA (US); Ruby Rani Patel, Los Angeles, CA (US)

( * ) Notice: Subject to any disclaimer, the term of this patent is extended or adjusted under 35 U.S.C. 154(b) by 211 days.

(21) Appl. No.: 17/765,808

(22) PCT Filed: Sep. 9, 2020

(86) PCT No.: PCT/GB2020/052164
§ 371 (c)(1),
(2) Date: Mar. 31, 2022

(87) PCT Pub. No.: WO2021/064344
PCT Pub. Date: Apr. 8, 2021

(65) Prior Publication Data

US 2022/0288502 A1 Sep. 15, 2022

(30) Foreign Application Priority Data

Oct. 4, 2019 (GB) ..... 1914370

(51) Int. Cl.
*A63H 33/08* (2006.01)
*A63H 33/16* (2006.01)
(Continued)

(52) U.S. Cl.
CPC ..... *A63H 33/084* (2013.01); *A63H 33/088* (2013.01); *A63H 33/16* (2013.01);
(Continued)

(58) Field of Classification Search
CPC .... A63H 33/084; A63H 33/088; A63H 33/16; E04B 2/08; E04B 2/18; E04B 2002/0217; E04C 1/39
See application file for complete search history.

(56) References Cited

U.S. PATENT DOCUMENTS 1,949,079 A * 2/1934 Loeffler ..... E04C 1/40 52/439
3,894,354 A * 7/1975 Crawley ..... A63H 33/16 446/124
(Continued)

FOREIGN PATENT DOCUMENTS

EP 0507970 A1 * 4/1991
ES 2019795 A6 7/1991
(Continued)

OTHER PUBLICATIONS

International Search Report and Written Opinion of The International Searching Authority issued in International Appl. No. PCT/GB2020/052164, dated Nov. 17, 2020, 8 pages.
(Continued)

*Primary Examiner* — Omar F Hijaz
(74) *Attorney, Agent, or Firm* — Bochner PLLC

(57) ABSTRACT

A stackable block, comprising: a wall having an inner surface and an outer surface, the wall comprising a strip of material having a first end and a second end with a plurality of transverse fold lines spaced there between, the wall configured to define a structure having an upper perimeter and a lower perimeter, wherein the structure is formed by the strip being folded about the transverse fold lines and the first and second ends being connected together, and wherein at least a portion of the inner surface is vertically offset from the outer surface such that the upper and lower perimeter have stepped configurations.

17 Claims, 12 Drawing Sheets

(51) Int. Cl.

| | |
|---|---|
| ***E04B 2/02*** | (2006.01) |
| ***E04B 2/08*** | (2006.01) |
| ***E04B 2/18*** | (2006.01) |
| ***E04C 1/39*** | (2006.01) |

(52) U.S. Cl.
CPC ..... *E04B 2/08* (2013.01); *E04B 2/18* (2013.01); *E04C 1/39* (2013.01); *E04B 2002/0217* (2013.01)

(56) References Cited

U.S. PATENT DOCUMENTS

| | | | | |
|---|---|---|---|---|
| 5,016,813 | A * | 5/1991 | Simons | B65D 5/4287 229/189 |
| 8,959,865 | B2 * | 2/2015 | Kratz | E04C 1/40 52/561 |
| 11,352,785 | B2 * | 6/2022 | Simmons, Jr. | E04C 1/00 |
| 2007/0130873 | A1 * | 6/2007 | Fisher | E04C 3/07 428/577 |
| 2019/0390452 | A1 * | 12/2019 | Baker | E04B 1/043 |
| 2020/0346816 | A1 * | 11/2020 | Sollie | B65D 5/32 |
| 2022/0136238 | A1 * | 5/2022 | Felton | E04B 2/16 52/596 |

FOREIGN PATENT DOCUMENTS

| | | | | |
|---|---|---|---|---|
| FR | 3002564 | A1 * | 8/2014 | E04C 1/00 |
| JP | S50152797 | U | 12/1975 | |
| JP | S57191398 | U | 12/1982 | |
| KR | 20180052343 | A | 5/2018 | |
| WO | WO-2014133472 | A1 * | 9/2014 | E04B 2/16 |

OTHER PUBLICATIONS

Notice of Refusal of the Japan Patent Office in related Japanese Patent Appl. No. 2022-520652, dated Jul. 29, 2024, 13 pages.

* cited by examiner 57
66
62
66
66
70
62
66
55
64

57
67
66
67
65
70
66
68
65
66
65
64
55

58
58a
58b
55
64
60a
60b
60
62
62
68
56
57

58a
58b
70
64
60b
60a
68
55

STACKABLE BLOCK

The present invention relates to a stackable block. In particular, a plurality of such a stackable block may be used for constructing a wall or a partition, for example.

Stackable blocks, such as cuboidal bricks, are widely used in the commercial construction of walls, buildings and other structures. They may also come in toy form. Such blocks are typically solid, or at least do not have any open sides, which allows them to be stacked in various staggered arrangements to produce a variety of different structure configurations. However, these bricks typically do not possess any interlocking properties, and therefore require a connecting medium such as mortar to assemble the bricks together securely.

Moreover, as bricks used for commercial construction are often entirely dense structures, they are usually heavy and expensive to transport. Attempts to address this problem have previously involved utilising cavities or hollow spaces within the blocks to reduce their weight. However, the blocks take up a large amount of space in transit and storage relative to their size and weight.

In the field of toys, Lego® produces various interlocking plastic bricks that have an upper surface extending between the (typically four) sides of the brick, which comprises one or more rows of studs configured to be received by the base of a similar brick to secure them together. According to a study by the University of Copenhagen Faculty of Science, six Lego® bricks having 2×4 studs can be combined in 915,103,765 ways. As with typical construction blocks, however, Lego® bricks are solid, rigid structures that usually have a series of internal hollow cavities, which means that the cost of transporting and storing such bricks includes the unavoidable transportation and storage of air.

Described herein is a stackable block, comprising a wall having an inner surface and an outer surface, the wall configured to define a structure having an upper perimeter and a lower perimeter, wherein at least a portion of the inner surface is vertically offset from the outer surface such that at least part of the upper perimeter and/or the lower perimeter has a stepped configuration. At least part of the upper and at least part of the lower perimeter may each have stepped configurations. The wall may comprise a strip of material having a first and second end and a plurality of transverse fold lines spaced therebetween, and the structure may be formed (or "assembled") by the strip being folded about the transverse fold lines and the first and second ends connected together.

According to the present invention there is provided a stackable block, comprising a wall having an inner surface and an outer surface, the wall comprising a strip of material having a first end and a second end with a plurality of transverse fold lines spaced there between, the wall configured to define a structure having an upper perimeter and a lower perimeter, wherein the structure is formed by the strip being folded about the transverse fold lines and the first and second ends being connected together, and wherein at least a portion of the inner surface is vertically offset from the outer surface such that the upper and lower perimeter have stepped configurations.

In this way, blocks may be transported or stored in an unfolded (e.g. "disassembled") form as a planar (e.g. flat) strip, rather than as a rigid (e.g. three-dimensional) structure. As the packing efficiency of strips is significantly greater than the packing efficiency of constructed blocks, the cost of transporting or storing the block may be significantly reduced.

The stepped configurations of the upper and lower perimeters enables strips to be arranged together in unfolded ("disassembled") form such that they tessellate in three-dimensional space, i.e. they fill space better. This prevents the unnecessary transportation or storage of enclosed voids or spaces, and hence air contained therein.

Moreover, a stackable block may be formed (or "assembled") in a quick and straightforward manner simply by connecting the ends of the strip together to define a structure. The resulting block can then be used to build a wall, for example, (or even furniture, such as a bed frame or dining table) without the need for tools, as a result of the interlocking block properties. Additionally, once the construction is no longer required for use, it can be easily dismantled and each block unfolded (e.g. "disassembled") and stored away as a strip until next required.

Preferably, the stepped configurations of the upper and lower perimeter have complementary profiles such that two or more blocks may be securely stacked. In this way, a robust interlock may be provided between two such blocks when stacked together by virtue of a complimentary interconnection provided between the stepped configuration of the upper perimeter of a first block and the stepped configuration of the lower perimeter of a second block stacked on top of it. In other words, as the vertical offset of the inner and outer wall on the upper perimeter is equal to the vertical offset of the inner and outer wall on the lower perimeter, a first block may be placed on top of a second block, such that relative movement between the blocks is inhibited. In addition, the stepped configuration may result in an improved distribution of weight between stacked blocks, thereby improving the overall structural stability of stacked arrangements.

Preferably, the upper perimeter has a stepped configuration around its entire length. Preferably, the lower perimeter has a stepped configuration around its entire length. In this way, the robust interlock between stacked blocks is provided around the entire perimeter wall, and the distribution of weight and structural stability between stacked blocks may further be enhanced.

The vertically offset portion of the inner surface of the wall may extend beyond (e.g. above) the outer surface of the wall. Alternatively, the vertically offset portion of the outer surface of the wall may extend beyond (e.g. above) the inner surface of the wall. In this way, a stepped configuration may be provided around the upper and/or lower perimeters of the block.

Preferably, the upper perimeter comprises a plurality of slots arranged to receive the lowermost step of the lower perimeter. In this way, one or more blocks may be arranged together in various staggered configurations to produce a variety of structures having different shapes. Additionally, or alternatively, slots may be provided on the lowermost step to allow the block to be orientated either way up.

Preferably, the plurality of slots are disposed in the uppermost step of the upper perimeter of the wall. In this way, the block is not required to bend or flex in order to be positioned within two or more slots of a second block. Therefore, the wall may comprise one or more rigid sections, and a loss in structural shape is not required for blocks to be able to fit or stack over each other.

Preferably, each slot of the plurality of slots has a depth equivalent to the extent (e.g. height) of the vertical offset between the inner and outer walls of the lower perimeter. In this way, the base of each slot coincides with the upper surface of the lowermost step of the upper perimeter, such that the weight of an above stacked block is distributed across the entire upper surface, rather than being simply distributed over the area of the slot.

Each slot of the plurality of slots may have a width that is substantially equal to the thickness of the lowermost step of the lower perimeter, so that the lowermost step of the lower perimeter of a second such block may be securely received within one or more slots of the block. In this way, the number of interfacing surfaces is maximised when blocks are stacked, and movement is prevented in all directions.

Each slot of the plurality of slots may have a width that is substantially equal to twice the thickness of the lowermost step of the lower perimeter, so that the lowermost step of the lower perimeter of a second such block and the lower step of the lower perimeter of a third such block may be securely received together within the or each slot of the block. In this way, a stacked arrangement may be formed wherein the lower perimeters of contiguous blocks are received in the same slot, such that it is possible to form a continuous structure of blocks without any gaps between adjacent outer walls. Moreover, the precise dimensions of the slot prevents movement in all directions, thereby resulting in a stable stacked arrangement.

The plurality of slots may be regularly spaced along the uppermost step of the upper perimeter of the wall. In this way, a regular arrangement of stacked blocks may be constructed.

Preferably, each slot of the plurality of slots has a corresponding slot that is disposed on the opposing wall of the structure. In this way, a block may be arranged such that its lower perimeter is received within both corresponding slots of a similar underlying block.

The slots of the plurality of slots may be perpendicularly arranged with respect to the length of the upper perimeter. In this way, one or more blocks may be stacked in a rectilinear arrangement.

Additionally, or alternatively, one or more slots of the plurality of slots may be obliquely arranged with respect to the length of the upper perimeter, thereby allowing two or more such blocks to be stacked together in an angled arrangement by receiving the lowermost step of the lower perimeter of a second such block within one or more slots in the uppermost step of the upper perimeter of the block. In this way, more complex stacking arrangements may be constructed, and curvilinear features may be provided on a large scale.

The wall may consist of (e.g. comprise only) said strip of material having a first and second end and a plurality of transverse fold lines spaced therebetween.

Preferably, the strip is substantially planar in unfolded (e.g. "disassembled") form. In this way, the block can be shipped flat making it easy to package and cost effective for shipping.

The stepped configuration may be provided by the strip being folded in a concertina arrangement in a longitudinal direction between the first and second ends. In this way, the strip is not required to be pre-formed with offset inner and outer surfaces. Instead, the stepped configuration may be formed at a later date, such as after the collapsed block has been shipped to its desired location. Hence, it is possible to reduce the manufacturing complexity, and thus the manufacturing cost. Moreover, shipping costs may be further reduced.

Preferably, material is removed (e.g. absent) from the strip to form a plurality of angled cut-outs each having a central vertical axis coinciding with one of the plurality of transverse fold lines, wherein each angled cut-out forms two angled surfaces in the wall, such that the two angled surfaces of each angled cut-out are brought into contact when the strip is folded about each respective fold line. In this way, when the strip is folded about the each fold line, the degree of folding is limited by the angled surfaces coming into contact. Hence, a more structurally stable constructed block is provided, and the shape of the constructed block may be tailored by varying the angle of the angled cut-outs. In one example, the strip may be formed with four 90 degree angled cut-outs, such that a square shape is constructed when the strip is folded about each fold line. In another example, the strip may be formed with three 120 degree angled cut-outs, such that a triangular shape is constructed when the strip is folded about each fold line. In another example, two or more strips may be folded and connected together to form a combined structure.

The stackable block may comprise a plurality of angled projections disposed on the inner surface of the strip adjacent each of the plurality of angled surfaces, wherein the angled projections extend the angled surfaces beyond the inner surface of the strip, such that when the strip is folded about each fold line the area of contact between angled surfaces is increased so as to provide additional structural support to the block. The angled projections also increase the surface area of the upper perimeter, thereby improving the distribution of weight and structural stability between stacked blocks Preferably, at least one of the plurality of angled projections may have a vertical hole extending through the at least one angled projection. In use, two or more such stacked blocks may be joined by inserting a connecting rod through their respective holes. In this way, the likelihood of stacked blocks becoming separated is reduced.

The stackable block may comprise at least one reinforcing element disposed in the wall to increase the rigidity of the block. In one example, the reinforcing element may be vertically arranged. In another example, the reinforcing element may be horizontally arranged. A star-shaped block (for example) will require angled projections disposed on both the inner and outer surfaces.

The stepped configuration around the (or each) upper perimeter and/or lower perimeter may be provided by a portion of the inner surface being vertically offset from the outer surface and a portion of the outer surface being vertically offset from the inner portion. A slot may be provided on the upper perimeter and/or lower perimeter at a location where the vertically offset portion(s) on the upper perimeter and/or lower perimeter change being on the inner surface to the outer surface, for example at a mid-point along the length of the side of the block. Alternatively, or additionally, the height of the vertically offset portions may vary in depth.

The at least a portion of the inner surface that is vertically offset from the outer surface to provide a stepped configuration may be provided by an attachable component that is attached to the upper perimeter and/or lower perimeter, for example a sticker. Additionally, or alternatively, lines of glue (or other similar adhesive material) may be built up layer by layer to a desired height on the upper and/or lower surface a block. For example, such a stepped configuration might be used for commercial displays or storage stacking (e.g. perfume boxes), whereby the stepped configuration may be added on the upper and/or lower surface of the block (e.g. which may be in the form of a box). This would allow a number of such boxes to be stacked together neatly (in any shape) to create a display, which could advantageously remove the need for shelf space.

As used herein, the term "block" includes structures or objects that do not have an upper or lower surface, but may instead comprise only side walls that define the shape of a three-dimensional (3D) structure, for example a rectangular or cuboidal block, having a hollow interior. The term "stackable" will be understood to mean that two such blocks can be stacked, optionally with at least partial overlap, upon one another. Thus, as referred to herein, a structure defined by the wall may be described as a three dimensional (3D) structure, or a structure having a three dimensional (3D) shape.

As used herein, the term "complex structure" preferably connotes a structure comprising two or more of the stackable blocks of the present invention. To increase the density of a complex structure, a building material (or another suitable ballast material) may be added within each of the blocks. For example, sand (temporary use) or concrete (permanent use) can be added within the blocks while the complex structure is being built and/or at the end.

The stackable block comprises a strip of material that forms the wall and is configured to allow the block to be constructed and to revert back into strip form. Thus, in certain configurations the wall may further allow the block to collapse (i.e. fold) flat onto itself when not in use and then open up into the block shape when in use. Such a configuration may be useful for a toy where structural integrity is not required and thus the strip material that forms the wall may be more flexible.

The stackable block of the present invention can be shipped flat, making it easy to package and cost effective to ship to the destination. When in strip form, it is also quick and straight forward to connect the ends of the wall together to form a block that can be used to construct a more complex structure (such as furniture, e.g. a bed frame or dinner table) without the need for tools, which can be used immediately. Additionally, once the structure is no longer required, or needs to be moved, for example, it can easily be dismantled and each block folded flat and stored or transported.

The following are non-limiting examples of possible uses for the stackable block of the present invention:

- Temporary indoor or outdoor shelter for displaced people when a natural disaster or weather related event forces families out of their homes for a period of time. After the event, the structures can be dismantled quickly and easily stored until next use.
- Furniture such as bed frames, tables and chairs, privacy walls, etc.
- If used at locations where, for example, a natural disaster has occurred, when a more urgent need rises the items of furniture can be dismantled and the stackable blocks repurposed. For example, bed frames, privacy walls, tables and chairs can be constructed out of this product if at first the number of shelters needed did not use up all the blocks. But if more people are displaced then these furniture structures will be reused to build more shelters.
- Longer-term indoor or outdoor shelter and furniture, for example using additional elements like insulation and reinforce rods. A shelter can thereby be constructed for semi-permanent use by homeless people or emergency/refugee camps in parts of the world where the temperature gets too hot/cold and tents are not suitable.
- Home and garden due to the stackable block being usable to build a structure that can easily be dismantled or moved it is therefore ideal for home and garden use as it should not require building permits. Such structures may include the following: car/workshop garage; garden shed greenhouse (e.g. using transparent material for the block); tree house; indoor & outdoor furniture; storage boxes; Rooms within rooms (e.g. sound studios having sound proofing material slotted into each block, play areas for kids, office rooms games room, etc.); garden walls, garden beds, steps; and sound proofed walls (again with sound proofing material slotted into each block, or the wall of the block itself formed from a suitable sound proofing material.
- Commercial use, such as small office rooms within large office spaces, including like cubicles, conference rooms, meeting rooms, etc.; office furniture, such as tables, printer stands, work stations, etc.; and trade show booths exhibits.
- Flood barriers in which the stackable blocks may comprise an elastic (e.g. rubber or plastic) material that gets sticky when wet, such that when two or more stackable blocks are connected together to form a combined wall structure, the connecting outer walls stick together forming a more secure and watertight structure.
- Security barriers built from blocks that are made from strong plastic material, ideally with metal frame ribs and additional angle supports.
- Storage containers may be formed by adding a base to a stackable block. A lid may also be provided to form a closable storage container.
- Toy structures may be built if the stackable blocks are of suitable size for a child to use, e.g. buildings, castles, furniture, etc.
- Lamps may be formed by using an opaque material for a stackable block, or a combination of blocks stacked on top of each other.

A stackable block according to the invention may further be used for IT chip circuitry, for example. The strip that forms the wall of the block may be constructed from circuit board, and when flat (e.g. "disassembled") a circuit may be built on the inner and outer wall of the strip without any restrictions. On completion of the circuit, the strip can be assembled into a block structure and thereby form a block circuit that efficiently combines a number of different circuits into a smaller area of space. Moreover, one or more such blocks may be stacked on top of each other such that they connect to form a larger circuit with high spatial efficiency.

Some exemplary embodiments of the invention will now be described, by way of example, with reference to the drawings, in which.

Figure 1B:
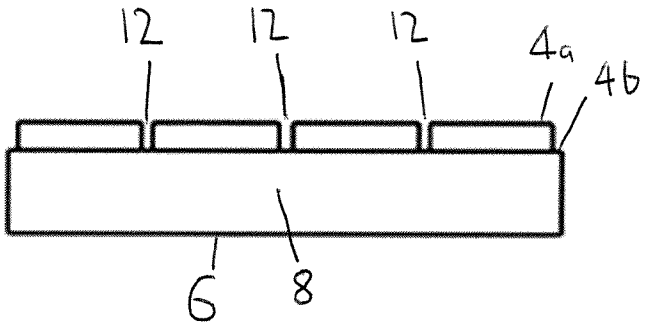
FIG. 1B is a side-view of the stackable block depicted in FIG. 1A.
Figure 1C:
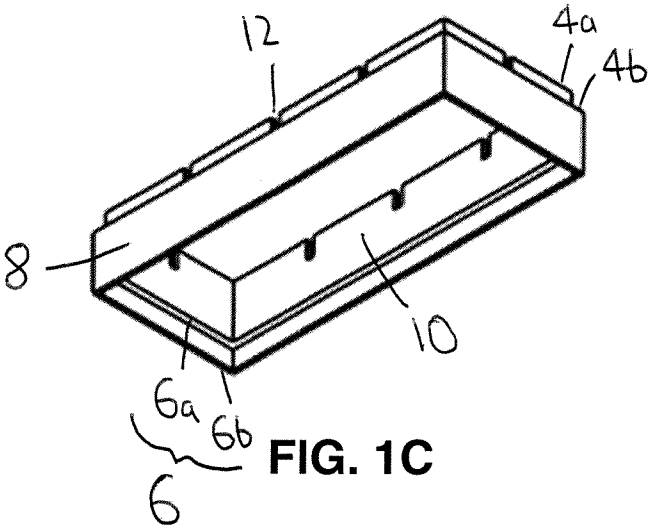
FIG. 1C is an alternative perspective view of the stackable block depicted in FIG. 1A.
Figure 1A:
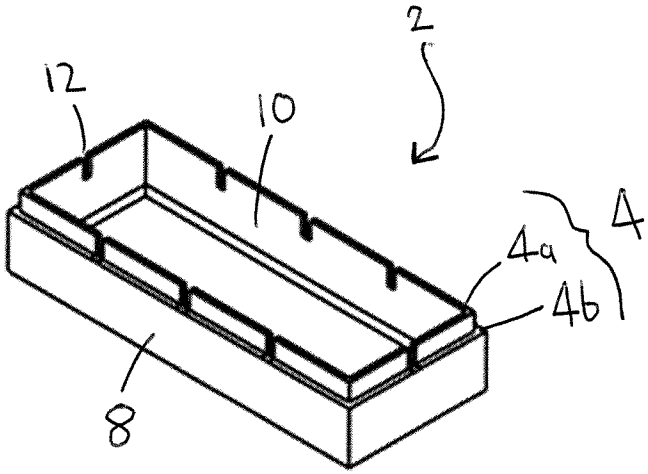
FIG. 1A is a perspective view of a stackable block according to the invention.

FIGS. 1A to 1C illustrate an example of a stackable block 2 according to the invention. The stackable block 2 is configured as a cuboid having an open top and bottom, i.e. it forms a rectangular perimeter wall defining a hollow interior. The stackable block 2 comprises an outer wall 8 and inner wall 10 that are vertically offset from one another. As such, the upper perimeter 4 of the stackable block 2 comprises an inner portion 4*a* and an outer portion 4*b*, wherein the inner portion 4*a* extends beyond the outer portion 4*b*. Correspondingly, the lower perimeter 6 comprises an inner portion 6*a* and an outer portion 6*b*, wherein the outer portion 6*b* extends beyond an inner portion 6*a*.

A series of slots 12 are disposed along the upper edge of the inner wall 10 of the stackable block 2 and arranged such that each slot 12 extends from the uppermost edge of the inner surface 4*a* down to the uppermost edge of the outer surface 4*b* of the upper perimeter 4. The slots 12 are regularly spaced along the length of each side of the stackable block 2. Each slot 12 has a corresponding slot 12 disposed along the upper edge of the inner wall 10 on the opposing side of the stackable block 2. As such, the slots 12 may be arranged in pairs on opposing sides of the block 2. The upper perimeter 4 of the block 2 may therefore be described as "castellated".

In an alternative arrangement, the outer wall 8 may extend above the inner wall 10, and the series of slots 12 may be disposed in the outer surface 4*b* of the upper perimeter 4.

Figure 2A:
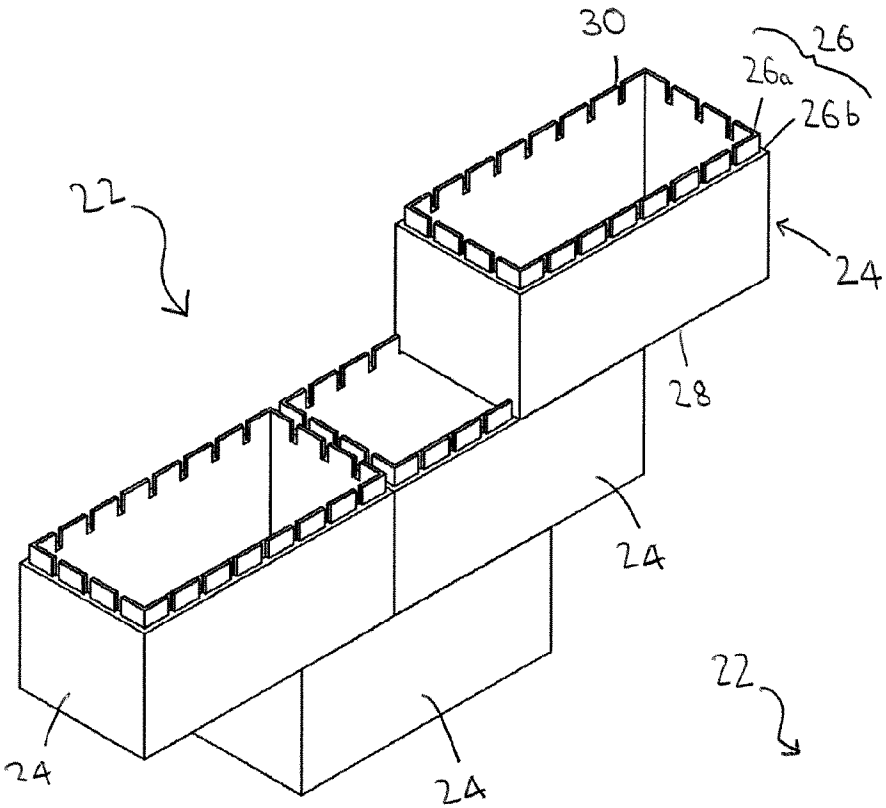
FIG. 2A is a perspective view of a stacked arrangement of stackable blocks comprising a plurality of slots according to the invention.
Figure 2B:
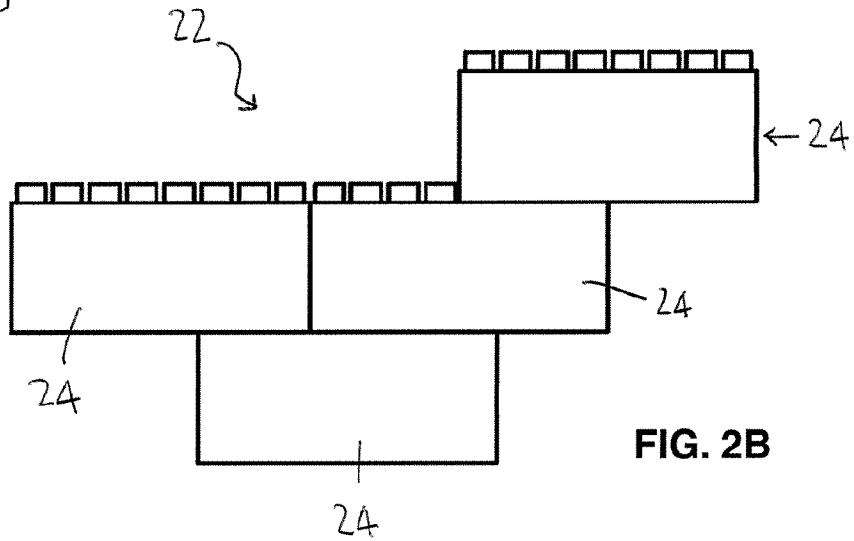
FIG. 2B is a side-view of the stacked arrangement depicted in FIG. 2A.

FIGS. 2A and 2B illustrate a plurality of blocks 24, similar to the block 2 described above in relation to FIG. 1 (but comprising additional slots 30), in a stacked arrangement 22. The upper perimeter 26 of the block 24 comprises a series of regularly spaced slots 30 that extend from the edge of the inner surface 26*a* of the upper perimeter 26 down to the edge of its outer surface 26*b*. In other words, the slots 30 have a height equal to the vertical offset of the edge of the inner surface 28*a* from the edge of the outer surface 28*b* of the lower perimeter 28. This results in the stacked arrangement 22 wherein the offset portion of the outer surface 28*a* of the lower perimeter 28 of a first block 24 is received within an opposed pair of slots 30 of a second such block 24 positioned below it, such that it lies flush along the edge of the outer surface 26*b* of the upper perimeter 26 of the second block 24. In addition, the inner surface 28*a* of the lower perimeter 28 of the first stackable block 24 rests on the inner surface 26*a* of the upper perimeter 26 of the second block 24. As a result, the weight of the first block 24 is well distributed across the upper perimeter 26 of the second block 24.

In this embodiment, each slot 30 is perpendicularly arranged with respect to the length of the upper perimeter 26 and has a width that is equal to twice the thickness of outer surface 28*b* of the lower perimeter 28. Therefore, the outer surface 28*a* of the lower perimeter 28 of two stackable blocks 24 may be positioned together within a single slot 30. This allows for a stacked arrangement 22 to be created comprising a continuous wall of stackable blocks 24 with no gaps between adjacent blocks. In other words, the outer walls of the blocks may be in parallel along the arrangement 22. In addition, the precise fit of the two stackable blocks 24 within each slot 30 prevents the undesirable movement of blocks and results in a stable stacked arrangement 22.

It will be appreciated by the skilled person that the slots 30 may be regularly and/or irregularly spaced along the length of the upper perimeter 26 of the stackable block 24.

In an alternative embodiment, a plurality of blocks 24 may be stacked together in different orientations relative to one another. For example, a first block 24 may be rotated 90 degrees with respect to a second underlying block 24, and received within the slots 30 of the second block 24.

Figures 3A, 3B, 3C:
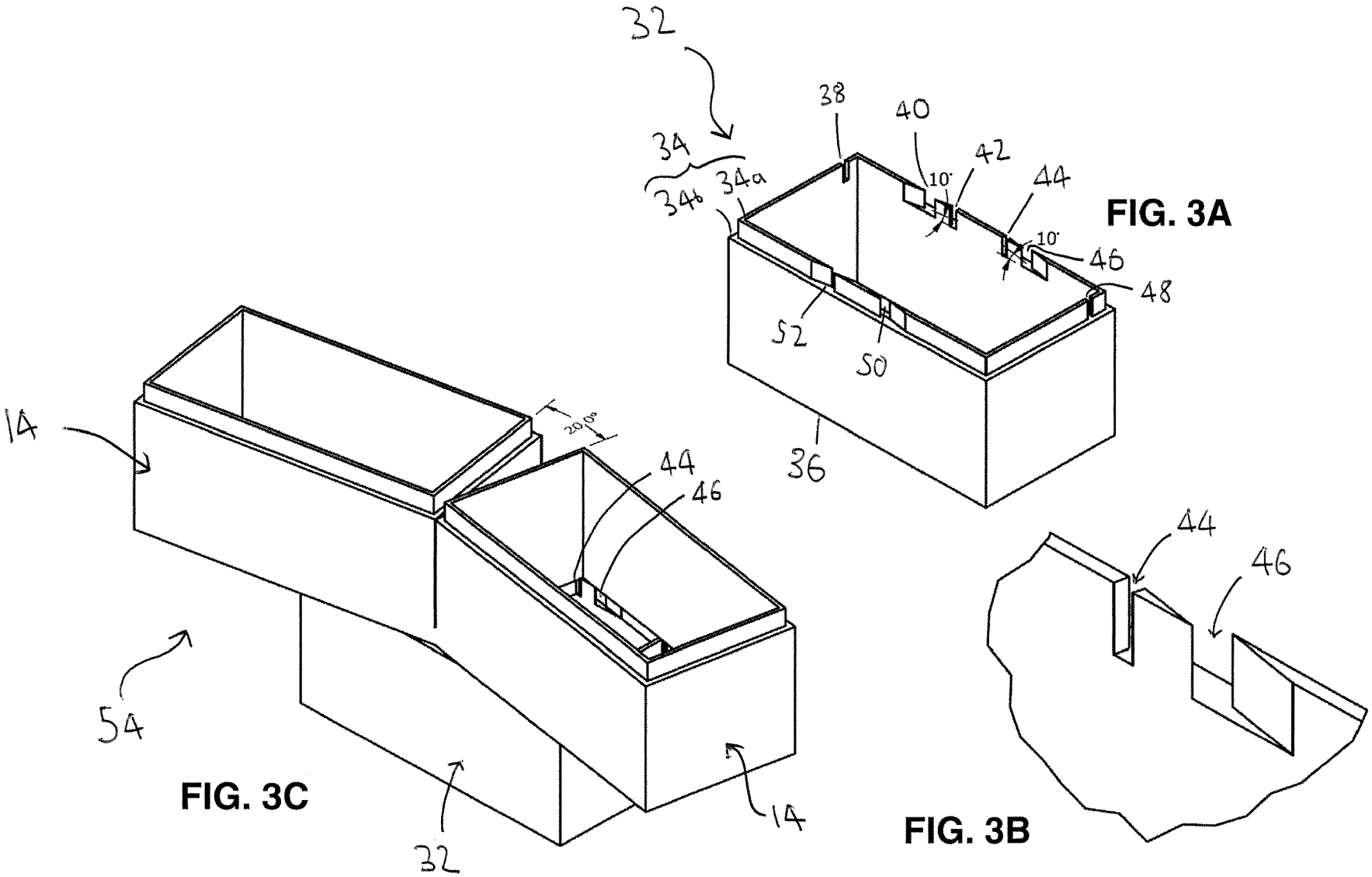
FIG. 3A is a perspective view of a stackable block comprising a plurality of obliquely arranged slots according to the invention.
FIG. 3B is a magnified view of the slots depicted in FIG. 3A.
FIG. 3C is a perspective view of a stacked arrangement of the stackable blocks depicted in FIG. 2A.
Figures 4A, 4B, 4C, 4D:
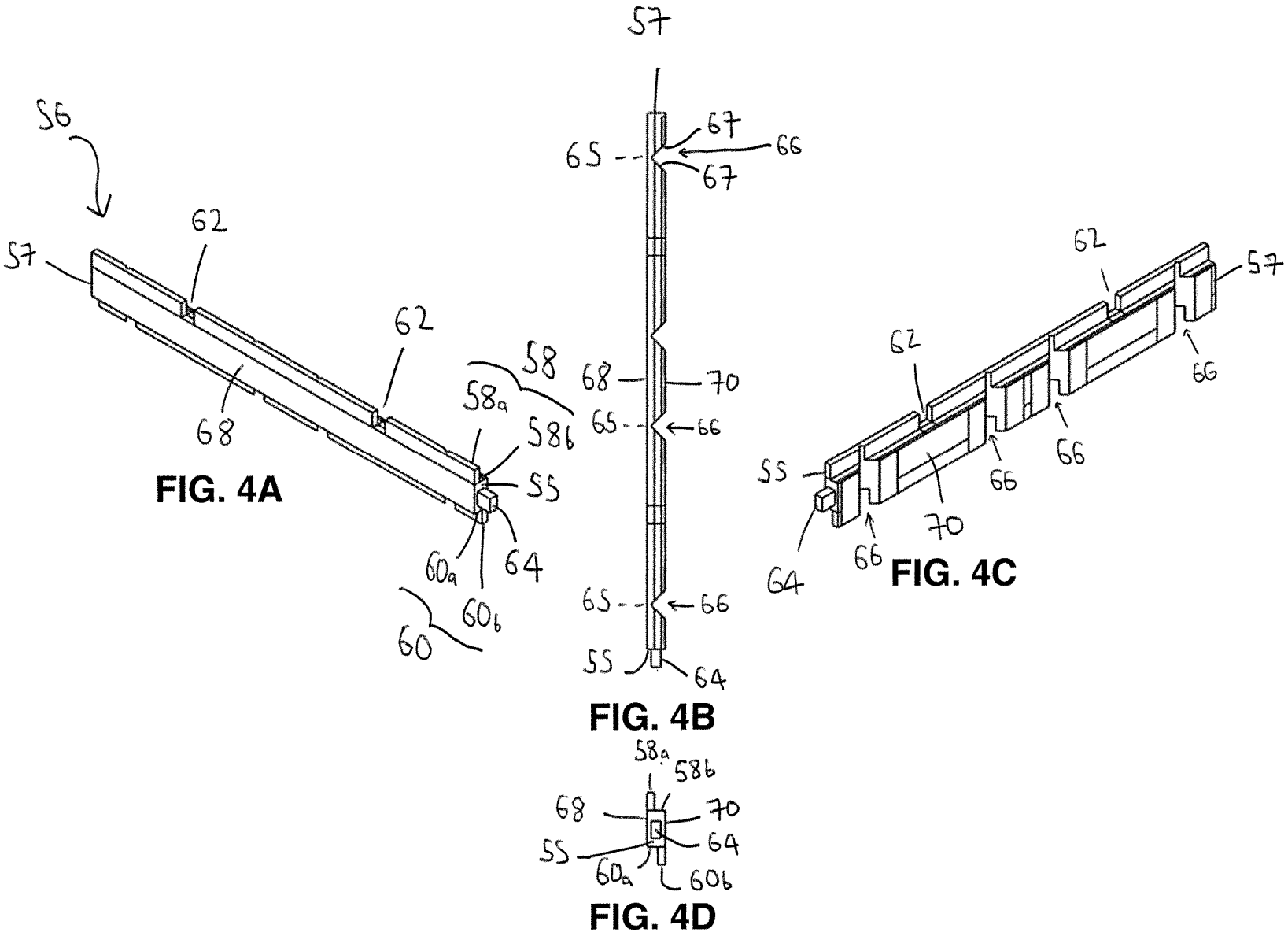
FIG. 4A is a perspective view of a strip that can be folded to form a stackable block according to the invention.
FIG. 4B is a top-view of the strip depicted in FIG. 4A.
FIG. 4C is an alternative perspective view of the strip depicted in FIG. 4A.
FIG. 4D is an end-view of the strip depicted in FIG. 4A.

FIG. 3A shows a stackable block 32 comprising obliquely angled slots 38, 40, 42, 44, 46, 50, and 52 provided in the inner surface 34*a* of the upper perimeter 34 of the wall of the block 32. As can be seen in FIG. 3B, the slots extend down to the edge of the outer surface 34*b* of the upper perimeter 34, and have a width substantially equal to the thickness of the outer surface of the lower perimeter of a further block 14. These dimensions allows two such stackable blocks 14 to be positioned within the slots 38, 40, 42, 52 and 44, 46, 48, 50 respectively to form the stacked arrangement 54 illustrated in FIG. 3C.

In the exemplary embodiment shown in FIGS. 3A and 3B, slot 46 lies at an angle of 10 degrees across the wall, and corresponding slot 50 on the opposing wall is identically orientated. Slot 44 is arranged to lie at a right angle to slot 46, and slot 48 is angled such that it is line with slot 46. This arrangement allows the block 14 to be stacked on top of block 32 by being received within the slots 44, 46, 48, and 50, such that the block 14 is angled at 10 degrees with respect to the block 32. Slots 38, 40, 42 and 52 mirror the orientation of slots 44, 46, 48, and 50 on the other half of block 32. This allows a further block 14 to be stacked on top of block 32 by being received within slots 38, 40, 42 and 52, such that the block 14 is angled at 10 degrees with respect to block 32 and forms an angle of 20 degrees with the other block 14, as illustrated in FIG. 3C.

It will be readily appreciated by a person skilled in the art that slots 38, 40, 42, 44, 46, 50, and 52 are not limited to the above specified angles, but may be arranged in other any orientation. For example, slots 44 and 50 may be angled at 25 degrees to the length of the wall of the stackable block 32 (with the angles of slots 38, 40, 42, 46, and 52 accordingly adjusted), such that two blocks 14 may be received within the slots to form a stacked arrangement wherein the blocks 14 are angled at 25 degrees with respect to block 32, but angled at 50 degrees with respect to each other.

Of course, a stackable block may have a combination of regular and angled slots along its perimeter to allow for greater flexibility of use.

It will also be understood by the skilled person that the upper blocks 14 in the stacked arrangement 54 may be replaced with similar blocks having slots. In this way, larger and more complex stacked arrangements may be constructed, with a range of angled relationships between each block. For example, structures which appear curvilinear on a large scale may be constructed.

FIGS. 4A to 4D illustrate a strip 56 that can be folded to form a stackable block according to the invention. The strip 56 comprises a first side 68 and a second side 70, an upper surface 58 having a first surface 58*a* that extends beyond a second surface 58*b*, and a lower surface 60 having a first surface 60*a* and a second surface 60*b*, wherein the second surface 60*b* extends beyond the first surface 60*a*. Slots 62 are disposed in the edge of the first surface 58*a* of the upper surface 58, and extend down to the edge of the second surface 58*b*. Transverse fold lines 65 are positioned along the length of the strip 56. Triangular prism sections of material have been removed from the surface of the second side 70 along the length of the strip 56 to form a plurality of angled cut-outs 60, each having a central vertical axis coincident with each fold line 65, and each forming two angled surfaces 67.

A fastening mechanism 64 is disposed at a first end 55 of the strip 56, such that the strip 56 may be folded about each fold line 65 and connected at the first end 55 and second end 57 by fastening mechanism 64 to form a stackable block having a closed wall structure. The fastening mechanism 64 may comprise a clasp, latch, clamp, tie, screw, hook, peg, magnet or any other type of fastener that may be used to fix the first end 55 and second end 57 of the strip 56 together.

The strip 56 may be folded about each of the transverse fold lines 65, thereby bringing the two angled surfaces 67 of each angled cut-out 66 into contact. The impingement of each pair of angled surfaces 67 prevents over-folding of the strip 56, and acts to constrain the shape of the resulting block. In this case, strip 56 has four 90 degree angled cut-outs 66, such that folding about each fold line 65 forms a stackable block having a rectangular perimeter wall. In an alternative example, the strip 56 may have three 120 degree angled cut-outs 66, such that folding about each fold line 65 forms a block having a triangular perimeter wall. In an alternative example, the strip 56 may have six 60 degree angled cut-outs 66, such that folding about each fold line 65 forms a block having a hexagonal perimeter wall. The skilled person will appreciate that the number of angled cut-outs 66, the side of the strip 56 that they are positioned on, and their angular relationships may be varied depending on the desired shape of the block. Moreover, two or more strips 56, having the same or different configurations of angled cut-outs 66, may be folded and connected together to form a compound shape.

Figure 5A:
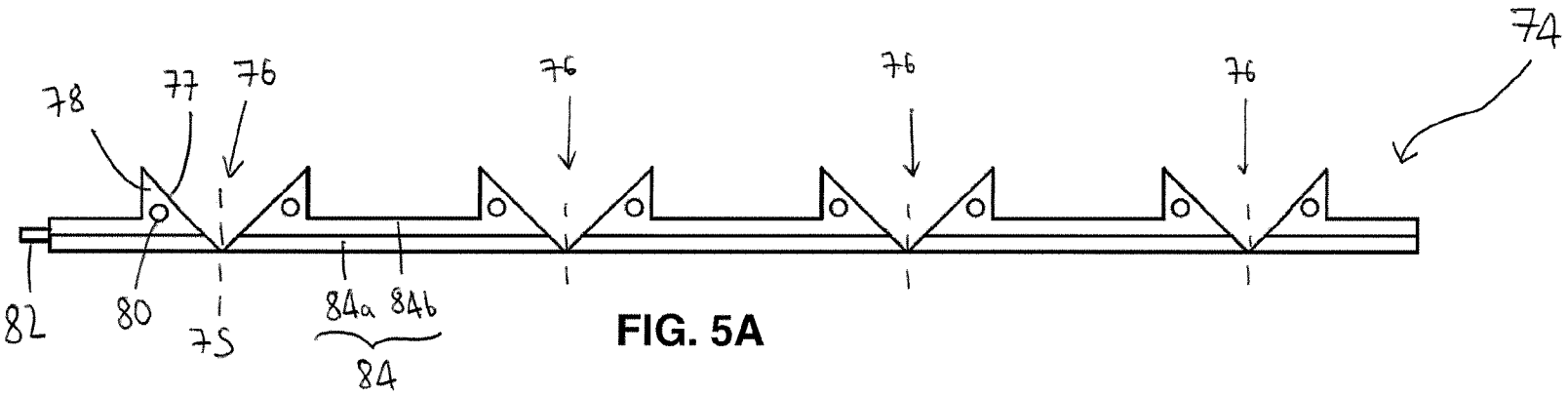
FIG. 5A is a top view of a strip comprising angled projections according to the invention.
Figure 5C:
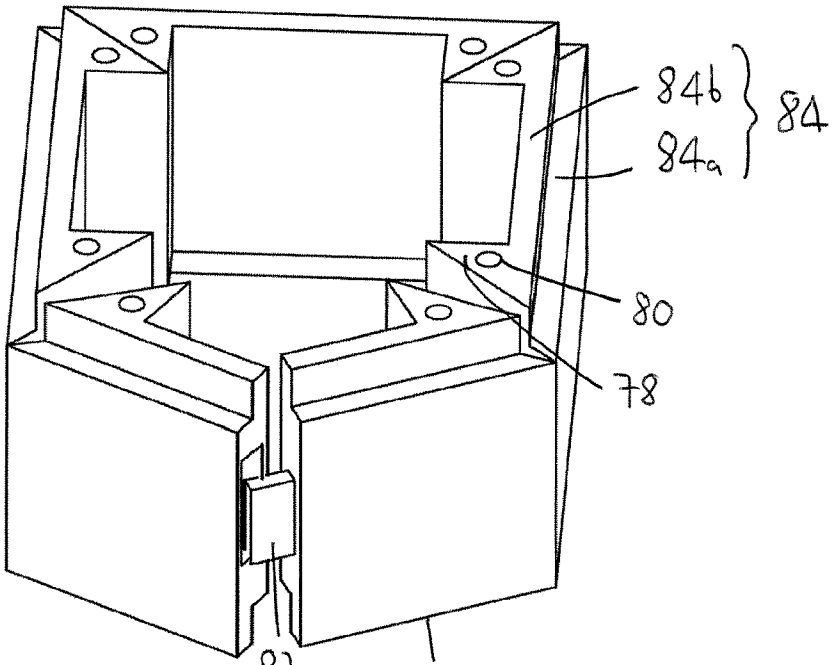
FIG. 5C is a perspective view of the strip comprising angled projections depicted in FIG. 5A illustrating a partially constructed block.
Figure 5B:
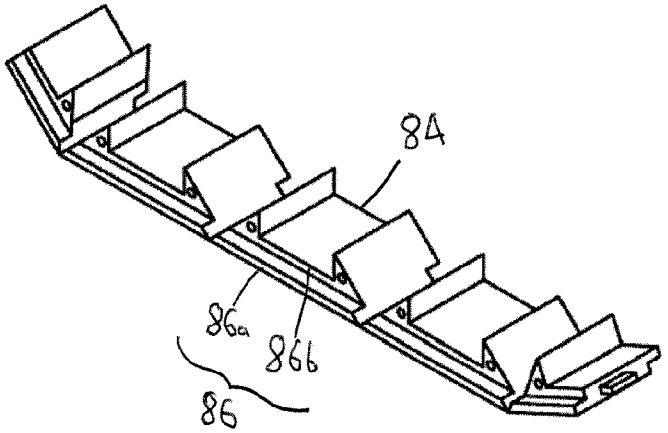
FIG. 5B is a perspective view of the strip comprising angled projections depicted in FIG. 5A.

FIG. 5A shows a side-view of a strip 74 that further comprises angled projections 78 located either side of each angled cut-out 76. Each angled projection 78 comprises a triangular prism of material containing a channel 80 extending perpendicular to the length of the strip 74. The angled projections 78 act to extend the angled surfaces 77 of each angled cut-out 76 further beyond the thickness of the strip 74. This increases the surface area of contact between angled surfaces 77 when the strip 76 is folded about each fold line 75, thereby resulting in a more robust block. If desired, the angle projection 78 may have a thickness that completely fills the hollow space within the block 32 to make a solid block 32 once formed. Moreover, each angled projection 78 increases the surface area of the second surface 84*a* of the upper surface 84 of the strip. Thus, as illustrated in FIGS. 5B and 5C, when the strip 76 is folded about each fold line 75 and connected using fastening mechanism 82 to form a block, the area of contact between stacked blocks is increased, leading to a stacked arrangement with an improved distribution of weight and improved structural stability.

In alternative examples, the angled projections 78 may comprise different shaped sections of material other than a triangular prism. In one example, the angled projections may comprise cuboidal sections of materials.

The channels 80 allow two or more stackable blocks to be connected using a connecting rod inserted through the channels 80 in adjacent blocks. This reduces the likelihood of stacked blocks coming apart from one another and provides a more stable stacked arrangement.

In alternative embodiments, the channels 80 may be positioned elsewhere in the strip 74, or they may be absent entirely. In one example, each angled projection 78 may comprise a semi-circular channel extending adjacent to the angled surface 77. Hence, when the strip 74 is folded about each fold line 75, two semi-circular channels will come together to form a single circular channel extending vertically through the strip 74.

Figure 6:
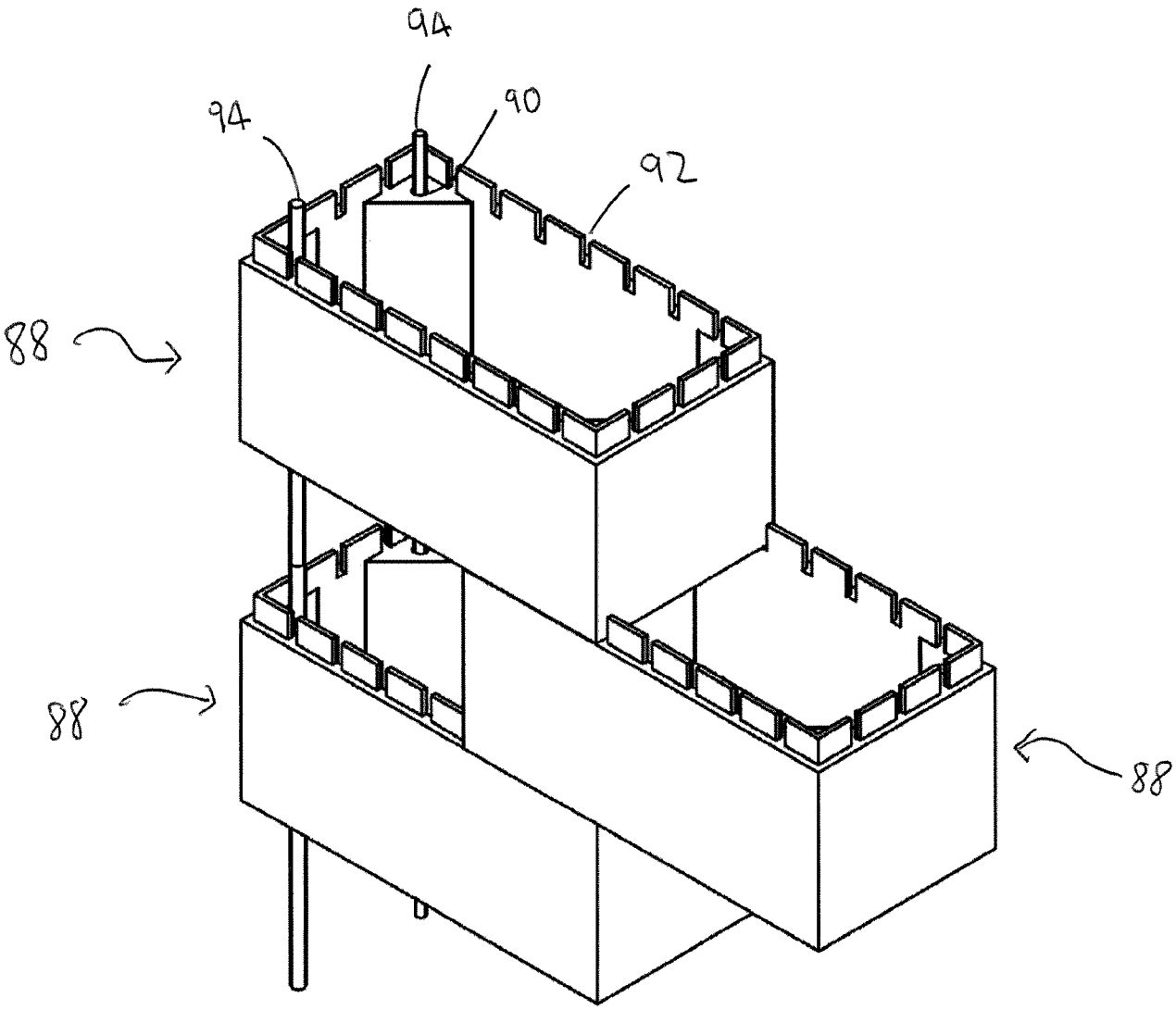
FIG. 6 is a perspective view of a stacked arrangement of stackable blocks comprising vertical holes connected by connecting rods according to the invention.

FIG. 6 shows a perspective view of three stackable blocks 88 comprising slots 92 in an embodiment of the invention. The blocks 88 are stacked via the slots 92 and coupled together using connecting rods 94 that extend through vertical channels 90 within the blocks 88.

Figure 7A:
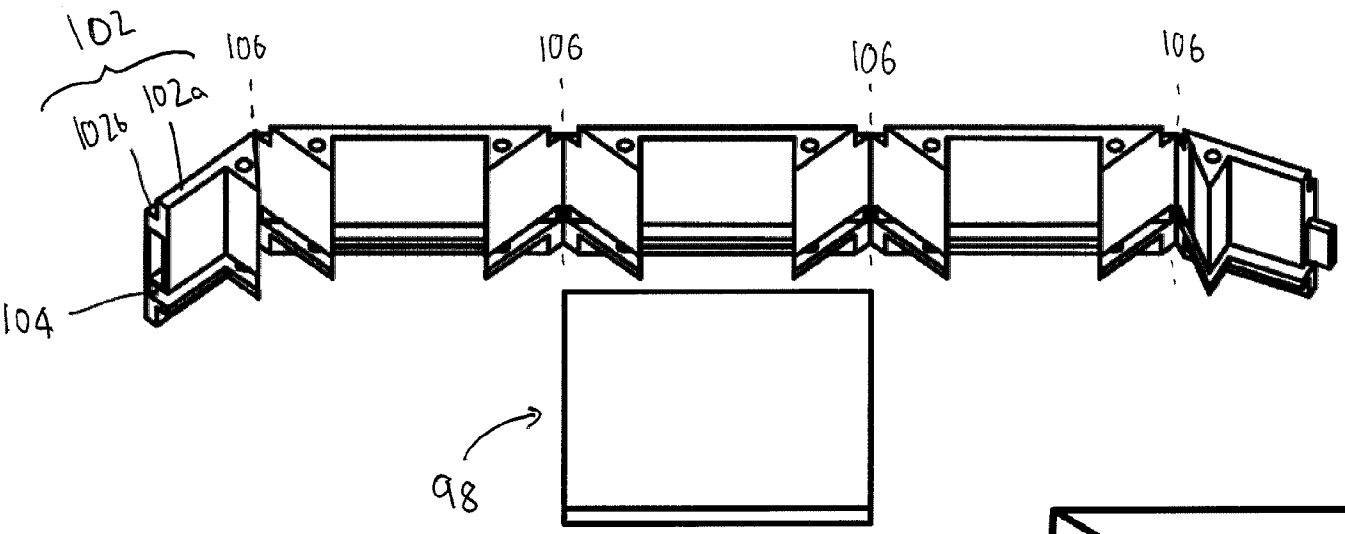
FIGS. 7A and 7B show perspective views of a deconstructed lid, base, and strip according to the invention.
Figure 7B:
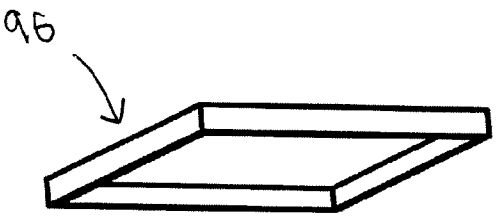

FIGS. 7A and 7B show perspective views of a deconstructed lid 96, base 98, and strip 100 in an embodiment of the invention. The strip 100 comprises an upper surface 102 with a first surface 102*a* that is vertically above a second surface 102*b*. The strip 100 also comprises a base slot 104 that extends along the length of the strip and is substantially the same thickness as the thickness of the base 98.

Figure 7C:
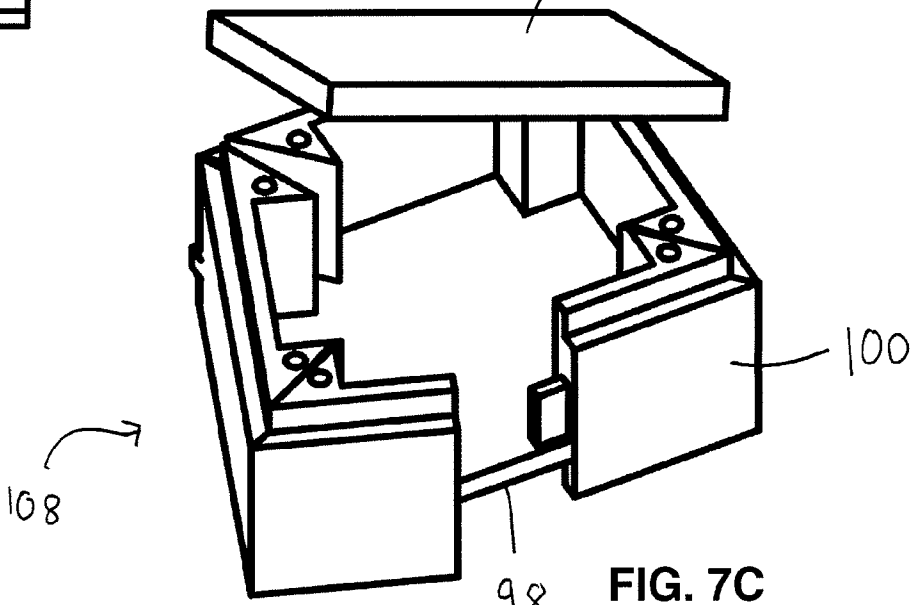
FIG. 7C is an alternative perspective view of the lid, base, and strip depicted in FIG. 7A in a partially constructed form.

Hence, as illustrated in FIG. 7C, the base 98 may be positioned within the base slot 104 and the strip 100 folded about each fold line 106 to form stackable block 108. The lid 96 may then be positioned on top of the block 108, such that the outer perimeter aligns with the first surface 102*a* of the upper surface 102 of the strip 100.

Figure 8B:
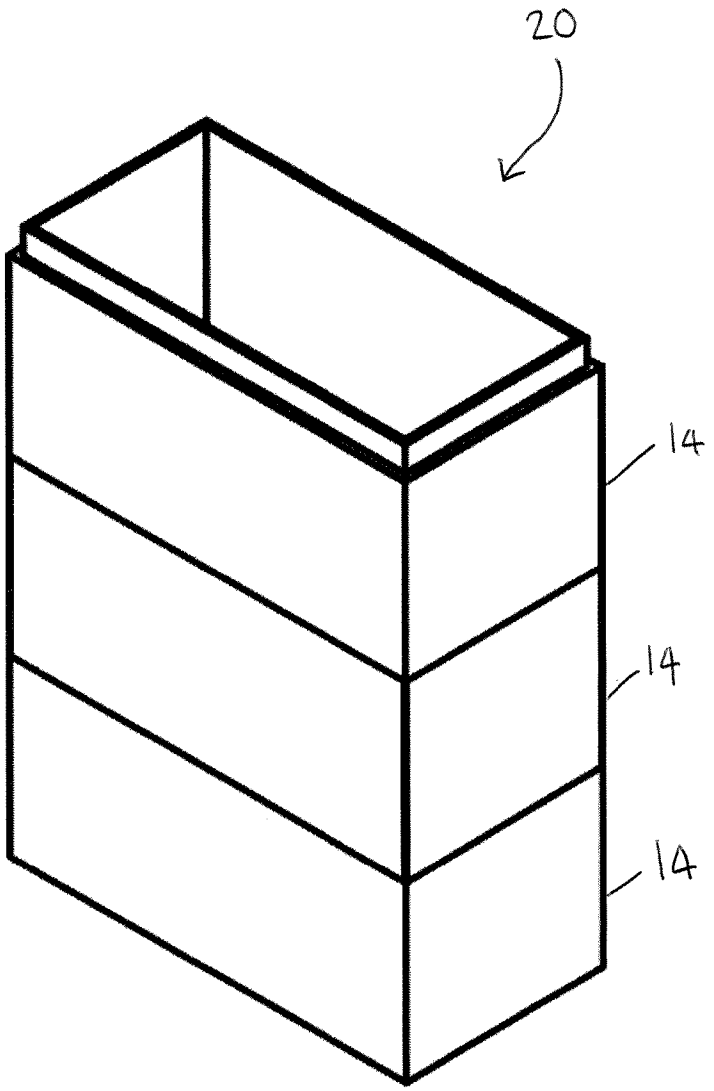
FIG. 8B is a perspective view of a stacked arrangement of the stackable block depicted in FIG. 8A.
Figure 8A:
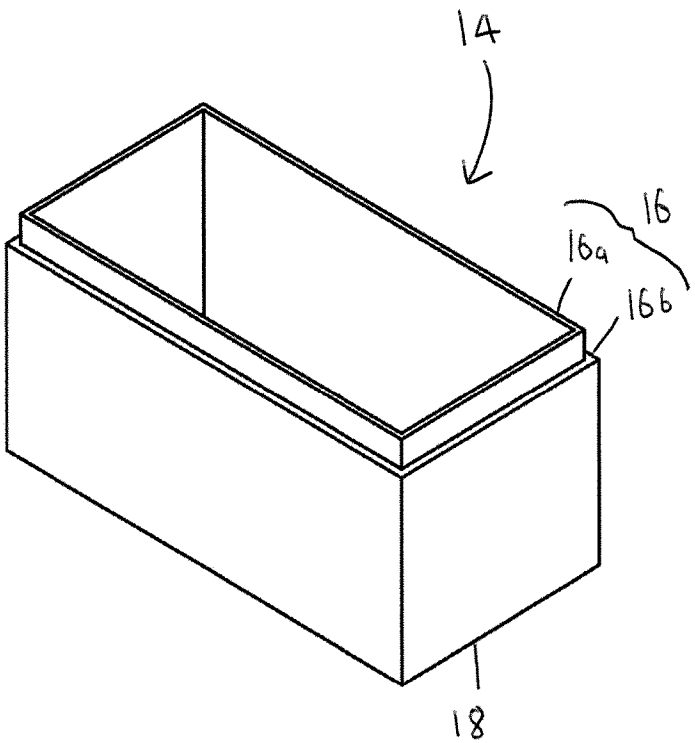
FIG. 8A is a perspective view of a stackable block according to the invention.

In another embodiment, the invention may provide stackable blocks that are configured simply to be stacked one directly atop another. FIG. 8A is a perspective view of a stackable block 14 in such an embodiment of the invention. The stackable block 14 comprises a wall having an upper perimeter 16 with an inner surface 16*a* that is vertically above the outer surface 16*b*. The stackable block also comprises a lower perimeter 18 have an inner surface 18*a* (not pictured) that is vertically above an outer surface 18*b* (not pictured). Hence, as illustrated in FIG. 8B, a number of stackable blocks 14 may be vertically aligned such that the inner surface 16*a* of the upper perimeter 16 of a first stackable block 14 contacts the inner surface 18*a* of the lower perimeter 18 of a second stackable block 14, and the outer surface 16*b* of the upper perimeter 16 of the first stackable block 14 contacts the outer surface 18*b* of the lower perimeter 18 of the second stackable block 14.

As such, a stacked arrangement 20 is formed with restricted movement between stackable blocks 14 due to the constraint imposed by the complimentary stepped configurations of the upper perimeter 16 and lower perimeter 18. In one example, the dimensions of the stepped configurations of the upper perimeter 16 and lower perimeter 18 may be precisely controlled to form an interference fit between two stacked blocks 14, thus enhancing the coupling of blocks 14 and improving the overall structural stability of the stacked arrangement 20. The skilled person will appreciate that the dimensions of blocks in the other described embodiments may also be configured to form an interference fit between connected blocks.

Figure 9A:
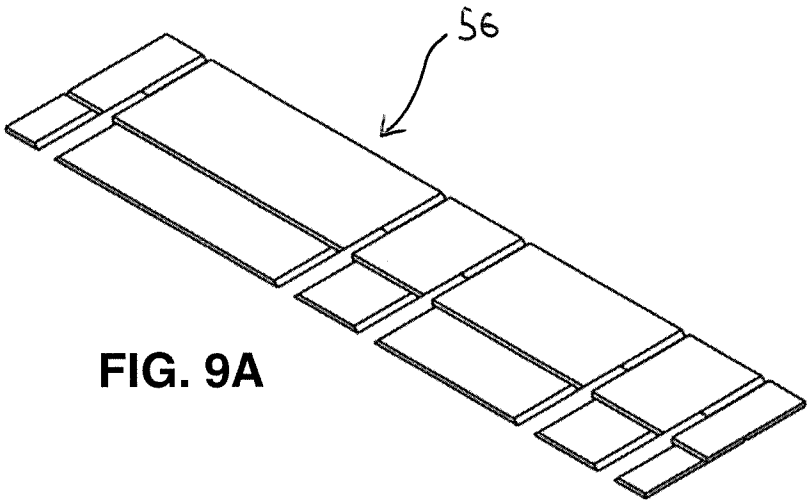
FIG. 9A is a perspective view of a deconstructed form of the strip depicted in FIG. 4A according to the invention.
Figure 9B:
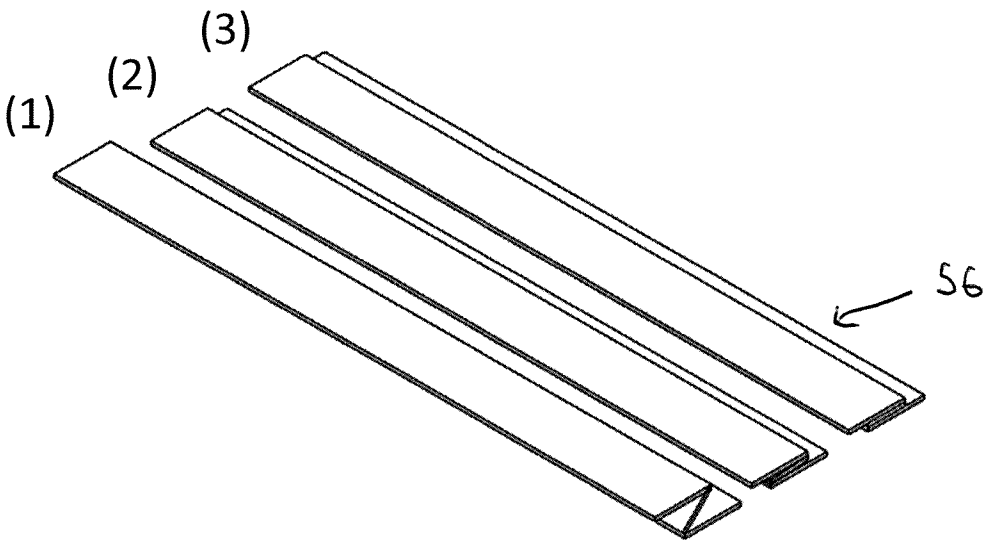
FIG. 9B is a schematic sequence illustrating the deconstructed form of the strip depicted in FIG. 9A being folded in a concertina arrangement to form the strip.

FIG. 9A illustrates the strip 56 of FIG. 5A in a deconstructed form. The deconstructed strip 56 may be folded in a concertina arrangement about two longitudinal fold lines, as illustrated in the schematic folding sequence of steps (1)-(3) shown in FIG. 9B, to form the strip 56 with an upper surface 58 and lower surface 60 arranged to define a stepped configuration.

Figure 10B:
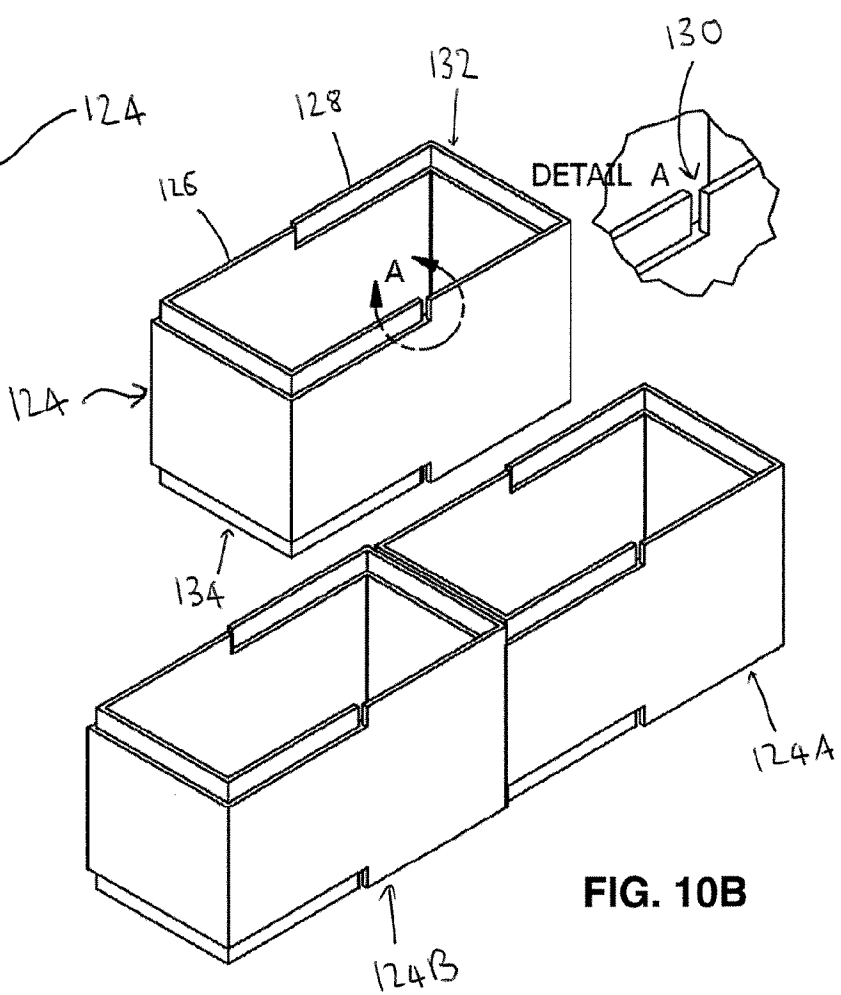
FIGS. 10A-10C show an alternative configuration of a stackable block.
Figure 10A:
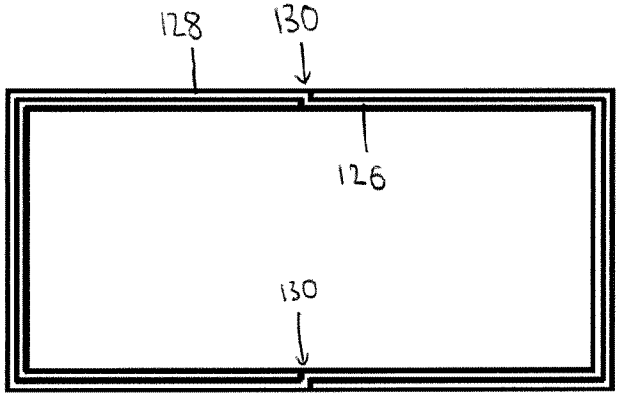
Figure 10C:
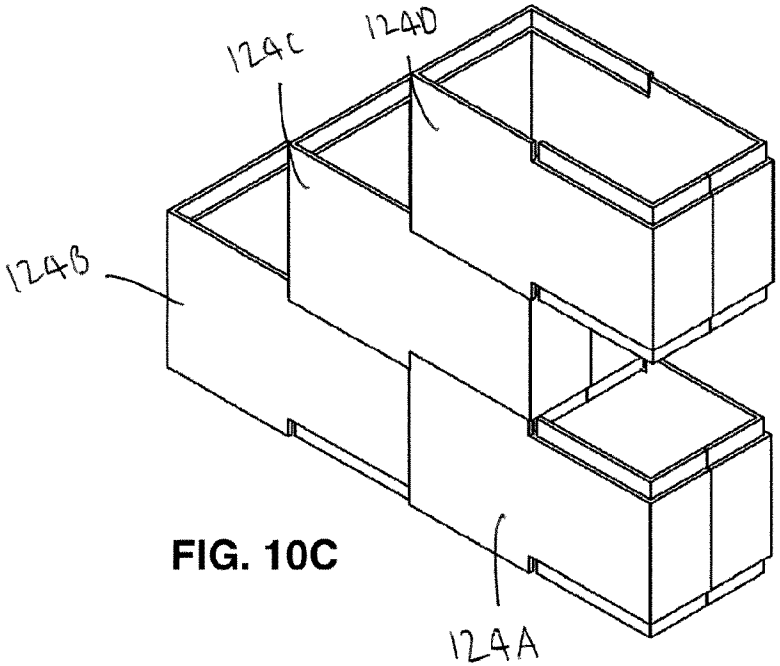

FIGS. 10A-10C show an alternative configuration of vertically offset portions on the inner and outer surfaces 126, 128 on a stackable block 124. Here, the stepped configuration around the (or each of) the upper perimeter 132 and/or lower perimeter 134 may be provided by a portion of the inner surface 126 being vertically offset from the outer surface 128 and a portion of the outer surface 128 being vertically offset from the inner portion 126. Opposing slots 130 may be provided on the upper perimeter 132 and/or lower perimeter 134 of the block 124 at the locations where the vertically offset portion(s) on the upper perimeter 132 and/or lower perimeter 134 change from being on the inner surface 126 to the outer surface 128, for example at a mid-point along the length of the side of the block 124, as shown in the plan view of a block in FIG. 10A and "Detail A" of FIG. 10B.

This alternative configuration may allow an additional interlock to take effect to secure together adjacent first and second ends of respective stackable blocks 124A, 124B, by placement of a third block 124C on top of them such that it bridges across the adjacent first and second ends of the two adjacent blocks 124A, 124B, as illustrated in FIGS. 10B and 10C.

Figures 11A, 11B, 11C:
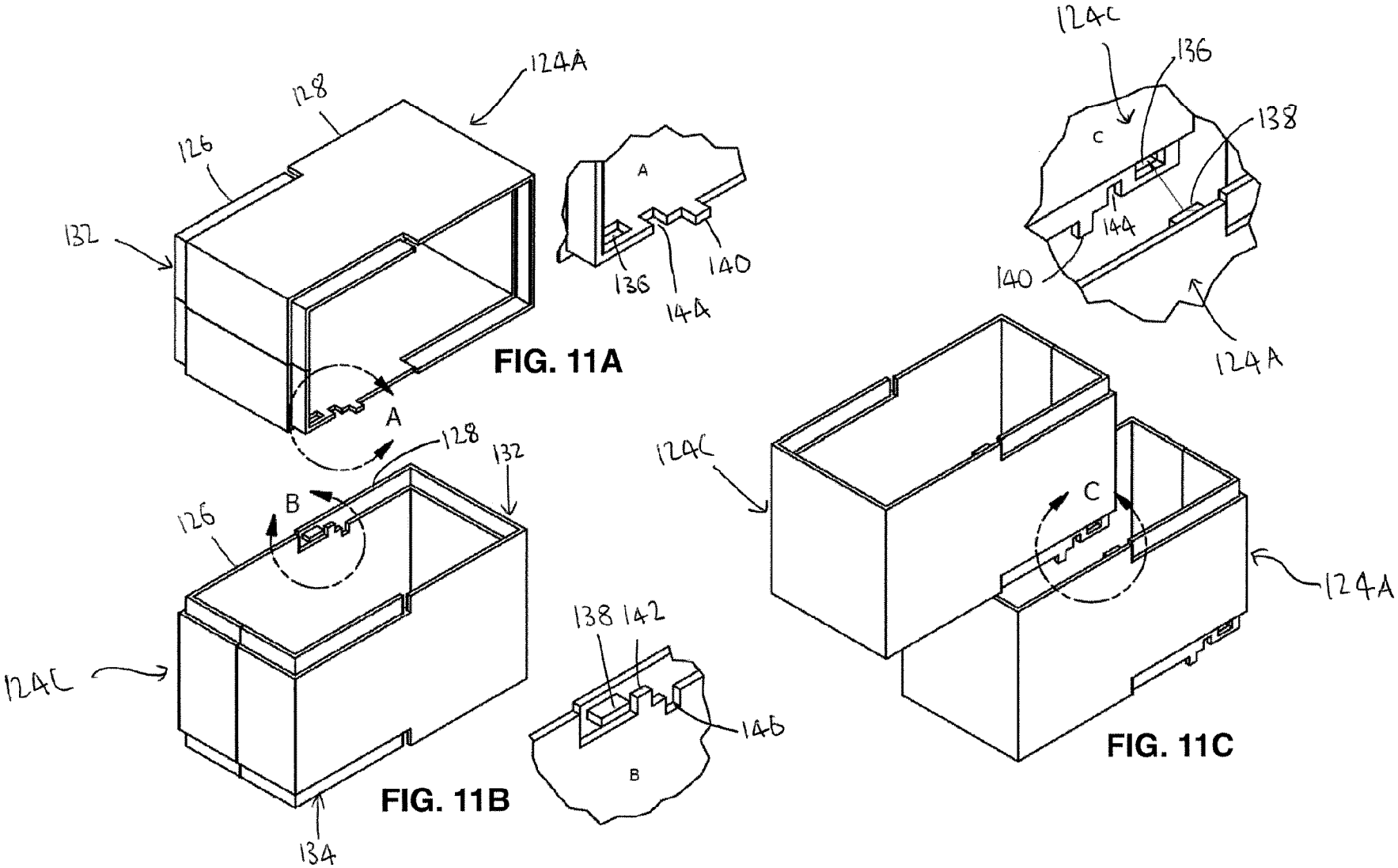
FIGS. 11A-11C show an alternative interlocking arrangement for the stackable block of FIGS. 10A-10C.

FIGS. 11A-11C show a modification of the configuration of the stackable block 124, of the embodiment shown in FIG. 1C, in which the vertically offset portion along the inner surface 126 of the upper perimeter 132 and/or lower perimeter 134 of the stackable block 124 is provided with an aperture 136 for receiving an inward projection 138 provided on the outer surface 128 of the vertically offset portion along the upper perimeter 132 and/or lower perimeter 134 of a corresponding stackable block 124. Vertical interlocking projections 140, 142 may also be provided on corresponding inner surfaces 126 and outer surfaces 126 of the block 124, to be received by corresponding receptacles 144, 146 so as to interlock. The aperture 136 and corresponding projection 138 can be seen in more detail in the enlarged views A-C of FIG. 11. This interlocking arrangement can provide a more robust construction/assembly of blocks 124.

Figure 12:
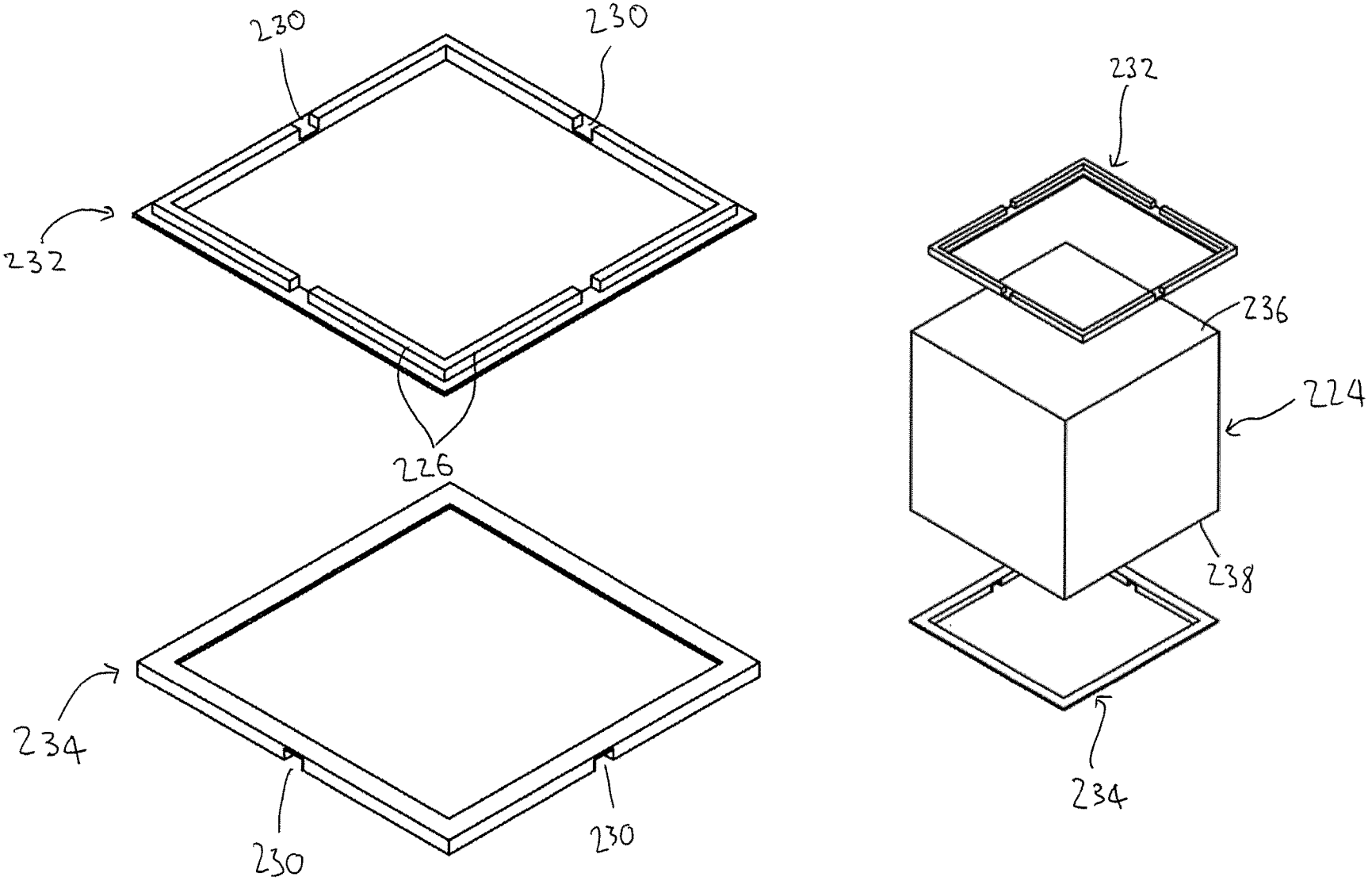
FIG. 12 shows an alternative arrangement for providing the vertically offset portions.

FIG. 12 shows a stackable block 224 in which the at least a portion of the inner surface 226 that is vertically offset from the outer surface to provide a stepped configuration with slots 230 is provided by attachable components 232, 234, for example a sticker, that are respectively attached to the upper perimeter 236 and lower perimeter 234 of the block 224. Additionally, or alternatively, lines of glue (or other similar adhesive material) may be built up layer by layer to a desired height on the upper and/or lower perimeter 236, 238 of block 224. Such a stepped configuration might be used for commercial displays or storage stacking (e.g. perfume boxes), whereby the stepped configuration may be added on the upper and lower surface of the block 224 (e.g. in the form of a box). This would allow a number of such boxes to be stacked together neatly (in any shape) to create a display, which could advantageously remove the need for shelf space.

As will be recognised by a skilled person, numerous advantages over the prior art are provided by the various inventive concepts disclosed herein.

Furthermore, it will be understood by the skilled person that any feature described in relation to a particular aspect herein may also be applied to another aspect described herein, in any appropriate combination. It will also be appreciated that particular combinations of the various features described and defined in any aspects described herein can be implemented and/or supplied and/or used independently.

In addition, any apparatus feature described herein may be provided as a method feature, and vice versa. Furthermore, as used herein, means plus function features may be expressed alternatively in terms of their corresponding structure. Moreover, it will be understood that the present invention is described herein purely by way of example, and modifications of detail can be made within the scope of the invention.

The invention claimed is:

1. A stackable block, comprising:

a wall having an inner surface and an outer surface, the wall comprising a strip of material having a first end and a second end with a plurality of transverse fold lines spaced there between, the first and second ends being configured to be connected together, wherein the wall is configured to define a structure having an upper perimeter and a lower perimeter, the structure being formed by the strip being folded about the transverse fold lines, wherein at least a portion of the inner surface of the wall is vertically offset from the outer surface of the wall such that at least part of the upper perimeter has a stepped configuration, and at least part of the lower perimeter has a stepped configuration, wherein the upper and lower perimeter have complementary stepped configurations such that two or more such blocks can be securely stacked, and wherein the vertical offset between the inner surface and the outer surface of the wall at the lower perimeter is equal to the vertical offset between the inner surface and the outer surface of the wall at the upper perimeter, such that when the stackable block is stacked upon a second stackable block, relative movement between the blocks is inhibited-, wherein material is removed from the strip to form a plurality of angled cut-outs each having a central vertical axis coinciding with one of the plurality of transverse fold lines, wherein each angled cut-out forms two angled surfaces in the wall, such that the two angled surfaces of each angled cut-out are brought into contact when the strip is folded about each respective fold line.

2. The stackable block of claim 1, wherein at least one of the upper perimeter and the lower perimeter has the stepped configuration around the entire length of said perimeter.

3. The stackable block of claim 1, wherein either:

the vertically offset portion of the inner surface of the wall extends above the outer surface of the wall; or the vertically offset portion of the inner surface of the wall extends below the outer surface of the wall.

4. The stackable block of claim 1, wherein the upper perimeter comprises a plurality of slots arranged to receive a lowermost step of the lower perimeter of another such block.

5. The stackable block of claim 4, wherein the plurality of slots are disposed in an uppermost step of the upper perimeter of the wall.

6. The stackable block of claim 4, wherein the plurality of slots are regularly spaced along an uppermost step of the upper perimeter of the wall.

7. The stackable block of claim 6, wherein each slot of the plurality of slots has a corresponding slot that is disposed on an opposing wall of the structure.

8. The stackable block of claim 4, wherein either:

each slot of the plurality of slots is perpendicularly arranged with respect to the length of the upper perimeter; or one or more slots of the plurality of slots is obliquely arranged with respect to the length of the upper perimeter, thereby allowing two or more such blocks to be stacked together in an angled arrangement by receiving the lowermost step of the lower perimeter of a second such block within one or more slots in the uppermost step of the upper perimeter of the block.

9. The stackable block of claim 4, wherein each slot of the plurality of slots has a depth equivalent to the extent of the vertical offset of an inner wall and an outer wall of the lower perimeter.

10. The stackable block of claim 9, wherein either:

each slot of the plurality of slots has a width that is substantially equal to the thickness of the lowermost step of the lower perimeter, so that the lowermost step of the lower perimeter of a second such block can be securely received within one or more of the plurality of slots of the block; or each slot of the plurality of slots has a width that is substantially equal to twice the thickness of the lowermost step of the lower perimeter, so that the lowermost step of the lower perimeter of a second such block and the lowermost step of the lower perimeter of a third such block can be securely received together within one or more of the plurality of slots of the block.

11. The stackable block of claim 1, wherein the wall consists of said strip of material.

12. The stackable block of claim 1, wherein at least one of:

the strip is substantially planar in unfolded form; and the stepped configuration is provided by the strip being folded in a concertina arrangement in a longitudinal direction between the first and second end.

13. The stackable block of claim 1, further comprising a plurality of angled projections disposed on the inner surface of the strip adjacent each of the plurality of angled surfaces, wherein the angled projections extend the angled surfaces beyond the inner surface of the strip, such that when the strip is folded about each fold line the area of contact between angled surfaces is increased so as to provide additional structural support to the block.

14. The stackable block of claim 13, wherein at least one of the plurality of angled projections has a vertical hole extending through the at least one angled projection, the vertical hole being arranged such that two or more such stackable blocks can be connected by inserting a connecting rod through their respective vertical holes.

15. The stackable block of claim 1, further comprising at least one reinforcing element disposed in the wall to increase the rigidity of the block.

16. A kit of parts, comprising two or more stackable blocks according to claim 1.

17. The stackable block of claim 1, wherein at least one of:

the upper and lower perimeter have complementary profiles such that a lid can be positioned on top of the block; and the upper and lower perimeter have complementary profiles such that a base can be added whereby to form a closable container.

* * * * *